US008448572B2

(12) United States Patent
Yang et al.

(10) Patent No.: US 8,448,572 B2
(45) Date of Patent: May 28, 2013

(54) WEB PRINTING SYSTEMS HAVING SYSTEM RESONANCE TUNER

(75) Inventors: Ming Yang, Fairport, NY (US); William J. Nowak, Webster, NY (US); Roger Leighton, Hilton, NY (US)

(73) Assignee: Xerox Corporation, Norwalk, CT (US)

( * ) Notice: Subject to any disclaimer, the term of this patent is extended or adjusted under 35 U.S.C. 154(b) by 316 days.

(21) Appl. No.: 12/822,244

(22) Filed: Jun. 24, 2010

(65) Prior Publication Data

US 2011/0315031 A1 Dec. 29, 2011

(51) Int. Cl.
*B41F 33/00* (2006.01)

(52) U.S. Cl.
USPC ..... 101/484; 101/216

(58) Field of Classification Search
USPC ..... 101/484
See application file for complete search history.

(56) References Cited

U.S. PATENT DOCUMENTS

| | | | | |
|---|---|---|---|---|
| 3,659,767 | A | 5/1972 | Martin | |
| 3,724,733 | A * | 4/1973 | Schaffer et al. | 226/25 |
| 3,949,655 | A * | 4/1976 | Gold | 493/32 |
| 4,218,026 | A | 8/1980 | Stange | |
| 4,610,739 | A * | 9/1986 | Jensen | 156/64 |
| 5,024,150 | A | 6/1991 | Brendel et al. | |
| 5,709,331 | A * | 1/1998 | Lam et al. | 226/4 |
| 5,816,152 | A * | 10/1998 | Nelgner et al. | 101/181 |
| 5,969,251 | A | 10/1999 | Tranquilla | |
| 6,032,004 | A | 2/2000 | Mirabella, Jr. et al. | |
| 6,250,146 | B1 | 6/2001 | Callendrier | |
| 6,543,353 | B1 * | 4/2003 | Ohlhauser et al. | 101/224 |
| 6,606,947 | B2 * | 8/2003 | Frossard et al. | 101/484 |
| 6,856,850 | B2 * | 2/2005 | Rajala et al. | 700/122 |
| 7,130,571 | B2 | 10/2006 | Berg et al. | |
| 7,191,973 | B2 | 3/2007 | Gretsch et al. | |
| 7,540,447 | B2 * | 6/2009 | Shiraishi et al. | 242/421 |
| 7,945,347 | B2 * | 5/2011 | Yang | 700/126 |
| 8,206,527 | B2 * | 6/2012 | Strunk | 156/64 |

FOREIGN PATENT DOCUMENTS

| | | | |
|---|---|---|---|
| DE | 199 07 078 | A1 | 8/2000 |
| DE | 199 07 079 | A1 | 8/2000 |
| WO | 2008/148596 | A1 | 9/2008 |

OTHER PUBLICATIONS

Reid et al., Dynamic Behavior of Dancer Subsystems in Web Transport Systems, Proceedings of the Second International Conference on Web Handling, pp. 135-146, Jun. 6-9, 1993.

* cited by examiner

*Primary Examiner* — Anthony Nguyen
(74) *Attorney, Agent, or Firm* — Gibb & Riley, LLC

(57) ABSTRACT

A method and apparatus herein supply one or more media characteristics of a continuous media material (such as printing media) being supplied to rollers of an apparatus (such as a printing apparatus). The method and apparatus adjust the position of at least one of the rollers/shafts, relative to other rollers/shafts, based on the media characteristics to cause the media material to exhibit a target resonance frequency when being processed through the rollers. The method and apparatus can also identify excitation frequencies of vibrations produced by the apparatus as the apparatus feeds the continuous media material along the rollers and set the target resonance frequency at a value that is different from the excitation frequencies to prevent the apparatus from exciting the continuous media material at or near a resonant frequency of the processing system transporting the continuous media material.

10 Claims, 5 Drawing Sheets

| 50 gsm-ORIGINAL POSITION | 75 gsm-ORIGINAL POSITION | 120 gsm-ORIGINAL POSITION | 50 gsm-TURNER 140 mm DOWN | 120 gsm-TURNER 140 mm UP |
|---|---|---|---|---|
| 15.661 | 19.137 | 23.194 | 19.823 | 19.66 |
| 30.98 | 39.469 | 49.077 | 32.607 | 48.974 |
| 75.485 | 96.187 | 119.574 | 79.224 | 98.56 |
| 81.899 | 104.389 | 129.832 | 99.763 | 119.574 |
| 110.789 | 141.233 | 175.674 | 116.275 | 175.665 |
| 211.764 | 269.951 | 335.777 | 225.282 | 332.975 |
| 9650.207 | 9650.22 | 9650.239 | 9650.209 | 9650.239 |

*FIG. 3*

WEB PRINTING SYSTEMS HAVING SYSTEM RESONANCE TUNER

BACKGROUND AND SUMMARY

Embodiments herein generally relate to continuous media ("web") processing systems, such as printers that use paper from continuous paper rolls, and more particularly to a processing system that adjusts the position of one of the rollers so that the critical resonance frequencies of the system are at different frequencies than one of the excitation frequencies produced by the processing system.

Good motion quality of direct marking systems using continuous paper web feeding is critical if high quality prints are to be produced. The overall motion quality is greatly affected by the paper/drive roll/idler roll system resonances, especially for the first several system resonance frequencies. A commonly accepted practice in good vibrations/motion quality engineering is to design systems to avoid all disturbance sources such as eccentricities from occurring at the system resonance frequencies. With photoreceptor (P/R) belt or intermediate transfer belt (ITB) systems, "tuning" the motion quality is a little easier since the belt material does not change and aligning system anti-resonances with system disturbances produced by shaft run-out or the like is typically unaffected significantly by changing paper weight. This principle, however, becomes very hard to enforce in continuous paper web systems since when paper weight is changed from one print job to the next, the stiffness between the roll inertias in the system changes and so does the system dynamic response, i.e., system resonance frequencies. The shift in resonance frequencies due to the change in media increases the range of frequencies the disturbance source needs to avoid and may create color registration or other motion quality related problems that even a dual reflex printing algorithm cannot accommodate.

One exemplary method herein comprises a process that provides one or more media characteristics of a continuous media material (such as printing media) being supplied to rollers of an apparatus (such as a printing apparatus). The method adjusts the position of at least one of the rollers, relative to other rollers, based on the media characteristics to cause the media material to exhibit a target resonance frequency when being processed through the rollers.

The method can also identify one or more excitation frequencies of vibrations produced by the apparatus as the apparatus feeds the continuous media material along the rollers and set the target resonance frequency at a value that is different from these excitation frequencies, to prevent the apparatus from exciting the continuous media material at a resonant frequency of the continuous media material. In some embodiments, this "target resonance frequency" is set at a value that is more than a predetermined frequency range outside the excitation frequencies so that the resonance frequency selected is well outside any potential excitation frequencies.

Thus, when the roll of media material is changed and a second continuous media material is supplied to the rollers of the apparatus, the method can then provide "second" media characteristics of the second continuous media material. The second continuous media material is different from the continuous media material, and the second media characteristics are different from the media characteristics. Given these second media characteristics, the method can then adjust the position of at least one of the rollers (based on the second media characteristics) to cause the processing system with the second media material to exhibit a critical resonance frequency when being processed through the rollers that is the same as (or within a predetermined frequency range of) the target critical resonance frequency.

An apparatus embodiment (which can potentially be a printing apparatus) includes rollers receiving a continuous media material (which can be a printing media material) from, for example, a supply roll. Further, a first component (such as sensors, a user interface, a network connection, etc.) is operatively connected to a controller. The first component can detect media characteristics of the continuous media material or the first component can be provided with such media characteristics of the continuous media material from the user, from a network, etc.

In turn, the first component provides the media characteristics of the continuous media material to the controller. An actuator is operatively connected to the controller and to at least one of the rollers. The actuator (under control of the controller) adjusts the position of at least one of the rollers (relative to other rollers) again based on the media characteristics, to cause the processing system to exhibit a target resonance frequency when being processed through the rollers.

The apparatus can also use a second component that is also operatively connected to the controller. Similar to first component above, the second component can comprise sensors, a user interface, a network connection, etc. The second component identifies one or more critical excitation frequencies of vibrations produced by the apparatus as the apparatus feeds the continuous media material along the rollers, and provides the excitation frequencies to the controller. The controller then sets the target critical resonance frequency at a value that is different from the excitation frequencies. Again, the target resonance frequency that is set by the controller can be at a value that is more than a predetermined frequency range outside the excitation frequencies so that the resonance frequency selected is well outside any potential excitation frequencies.

If the supply roll is changed to a different media material, the first component can provide second media characteristics of the second continuous media material being supplied to the rollers. In turn, the controller adjusts the position of at least one of the rollers (based on the second media characteristics) to cause the processing system with the second media material to exhibit a second resonance frequency when being processed through the rollers that is the same as (or within a predetermined frequency range of) the target resonance frequency.

These and other features are described in, or are apparent from, the following detailed description.

BRIEF DESCRIPTION OF THE DRAWINGS

Various exemplary embodiments of the systems and methods are described in detail below, with reference to the attached drawing figures, in which:

FIG. 3 is a table illustrating the resonance frequencies for different paper weights;

DETAILED DESCRIPTION

As mentioned above, high motion quality of print media in the print zone (which is affected by the system resonance frequencies) is difficult to achieve in continuous paper web systems because paper weight, temperature, humidity, etc., can change and these changing environmental conditions shift the resonance frequencies of the media, which increases the range of frequencies the disturbance sources need to avoid, complicating design of devices that use web feed systems.

In view of such issues, the embodiments herein adjust the location of one or more rolls that are critical to controlling the resonances of the media. With embodiments herein, the resonance of the apparatus system is adjusted to keep the web resonance away from the excitation frequencies of the disturbances. Thus, embodiments herein can keep the critical resonance frequency of the apparatus system (the vibrations of the web material, rollers, etc.) approximately the same for all conditions (changing media weight, thickness, flexibility, etc.; changing temperature, humidity, etc.) thus maintaining the designed relationship between system's resonances and excitation sources. The embodiments herein allow different paper weights to be used with similar good quality motion.

Figure 1:
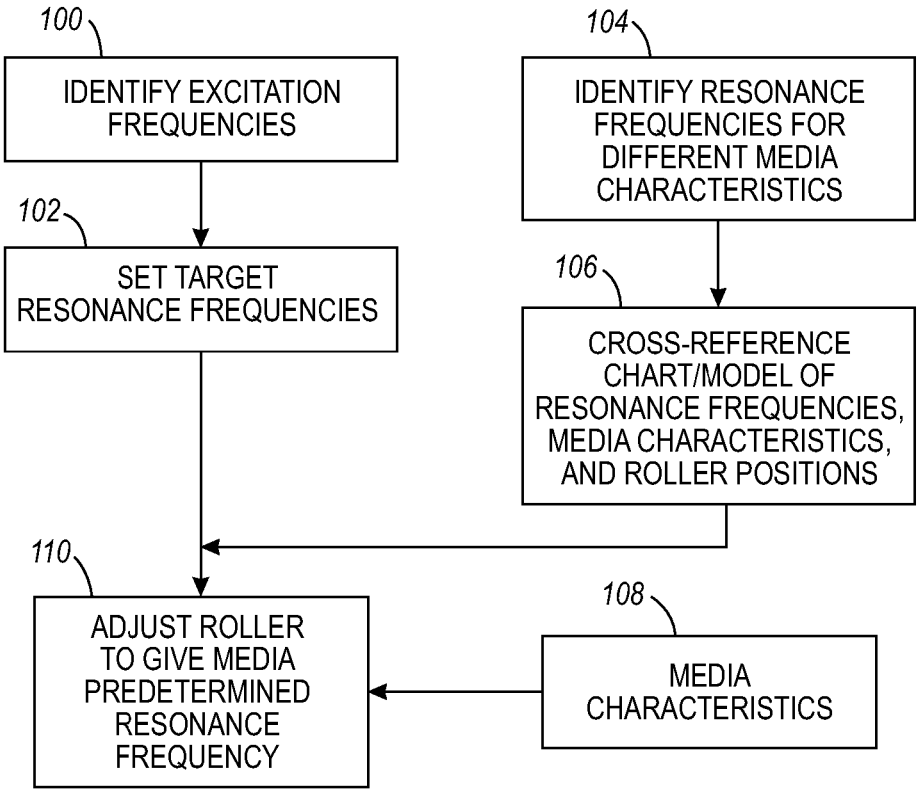
FIG. 1 is a flow diagram illustrating embodiments herein.

As shown in flowchart form in FIG. 1, one exemplary embodiment herein comprises a process that identifies one or more "excitation frequencies" of vibrations that are naturally produced by an apparatus (such as a printing apparatus) as the apparatus feeds a continuous media material (such as printing media) along rollers of the apparatus (item 100). These excitation frequencies can be identified through empirical testing, modeling, historical experience, etc. In item 102, the embodiments herein set a "target resonance frequency" (that is used as described below) at a value that is different from the identified excitation frequencies.

Different combinations of media characteristics (stiffness, thickness, weight, width, humidity, temperature, etc.) and different roller locations cause the resonance frequency of the processing system (the vibrations of the web material, rollers, etc.) to change. Therefore, in item 104, the embodiments herein identify resonance frequencies for different combinations of media characteristics and roller locations, and in item 106 create a cross reference chart (or model) of the resonance frequencies for the different media characteristics and roller locations. This chart/model 106 can also be created through empirical testing, modeling, historical experience, etc.

In item 108, an exemplary embodiment provides one or more media characteristics of the continuous media material being supplied to system of the apparatus. In item 110, the methods herein adjust the position of at least one of the rollers, relative to other rollers (based on the media characteristics and the cross-reference chart/model 106) into a position to cause the processing system (the continuous media material, the rollers, etc.) to exhibit the target resonance frequency (that was set in item 102, above) when the media is being processed through the rollers.

In other words, the embodiments herein establish the target resonance frequency at some frequency that is always different from the excitation frequencies produced (generated) by the apparatus. To determine the proper positions of the rollers, the embodiments herein apply the supplied media characteristics and the target resonance frequency to the cross-reference chart/model 106. The embodiments herein then adjust the position(s) of the roller(s) that are handling the continuous media material into the position indicated by the cross-reference chart/model 106 to have the processing system exhibit the target resonance frequency. Therefore, the relation that the critical system resonance frequency is away from the disturbance excitation frequencies will not be changed even if the media material is changed.

More specifically, in item 102, the embodiments herein set the target resonance frequency at a value that is different from the excitation frequencies in order to prevent the apparatus from exciting the continuous media material at one of the resonant frequencies of the processing system. In some embodiments, the target resonance frequency can even be set at a value that is more than some "predetermined frequency range" outside the excitation frequencies so that the resonance frequency selected is well outside any potential excitation frequencies. In other words, if one of the excitation frequencies was found to be 1000 Hz, the "predetermined frequency range" could be 100 Hz, requiring that the target resonance frequency be less than or equal to 950 Hz, or greater than or equal to 1050 Hz.

Further, when setting the target resonance frequency in item 102, the embodiments herein select a target resonance frequency that is achievable according to the capabilities illustrated in the chart/model 106. Thus, when the roll of continuous media is changed and a second (different) continuous media material (having second (different) media characteristics) is supplied to the rollers of the apparatus, the methods herein make adjustments to deal with the second media characteristics of the second continuous media material. Given these second media characteristics, the method can adjust the position of at least one of the rollers (based on the second media characteristics and cross-reference chart) to cause the processing system with the second media material to exhibit the same target resonance frequency (or a frequency within a predetermined frequency range (e.g., within 10 Hz, 100 Hz, 1000 Hz, etc.) of the target resonance frequency).

Figure 2:
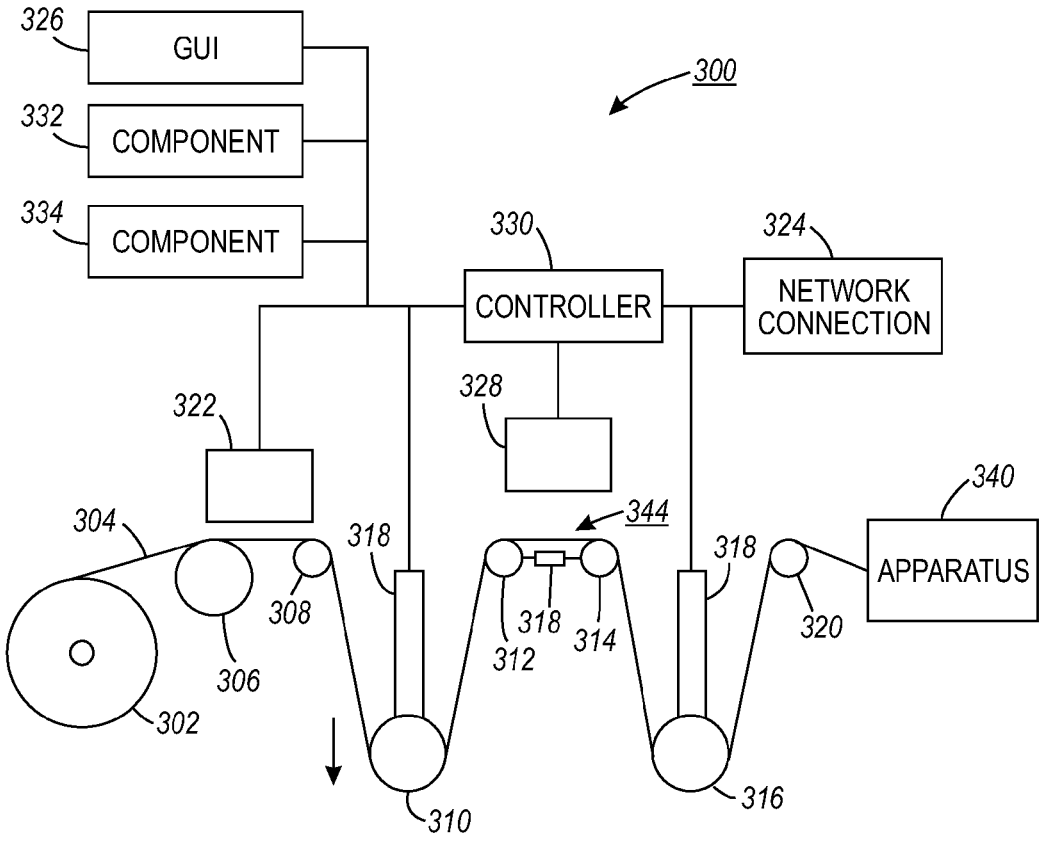
FIG. 2 is a side-view schematic diagram of a device according to embodiments herein.

FIG. 2 illustrates an exemplary apparatus embodiment 300 (which can potentially be a printing apparatus) that includes rolls (which are sometimes referred to herein as rollers or shafts) 306, 308, 310, 312, 314, 316, 320. The rollers shown in FIG. 2 can be in a fixed location, can be mounted on shock absorbers or springs, or can be connected to actuators 318 that move the positions of certain rollers (310, 316.)

The rollers receive a continuous media material 304 from, for example, a supply roll 302, past a processing station 328, through a control zone 344, and eventually to an apparatus 340 that may perform additional processing. The focus of some embodiments herein is to control the frequency of the vibrations and oscillations (the resonance frequency) of the processing system and the web material 304 within the control zone 344. The apparatus 300 can comprise any form of apparatus that uses continuous web feed media/material (apparatus for metal sheet processing, plastic film processing, polymer sheet processing, cloth sheet processing, etc.). Thus, the processing station 328 can perform any necessary activity, such as stamping, bonding, cutting, staining, printing, etc., of the web material 304 within the control zone 344 in a reliable and predictable manner If the device 300 comprises a printer or printing device (although the embodiments herein are not limited to such a device) the processing station 328 can comprise, for example, a printing engine or marking engine (the details of which are well-known to those ordinarily skilled in the art). In such a printing device 300, the control zone 344 is a "printing zone" and the apparatus 340 can comprise a finisher that processes the web material after printing has been completed.

Further, a first component 332 (connected to sensors 322, a network connection 324, a graphic user interface (GUI 326), etc.) is operatively connected to a controller 330. The first component 332 can detect media characteristics of the continuous media material (if it is connected to, for example, one or more sensors 322) or the first component can be supplied such media characteristics of the continuous media material from the user, from a network, etc. (through, for example, the network connection 324 or user interface 326).

In turn, the first component 332 supplies the media characteristics of the continuous media material to the controller 330. The controller 330 can perform calculation of resonance frequencies fast enough to perform roll location adjustment requirement in real time in response to a change of web media, such as different paper weight and different paper thickness in continuously fed printers.

The actuators 318 are operatively connected to the controller and to at least one of the rollers. The actuator(s) 318 (under control of the controller 330) adjust the position of at least one of the rollers (relative to other rollers) again based on the media characteristics and sensed environmental conditions, to cause the processing system and the media material 304 to exhibit a target resonance frequency when being processed through the rollers. While only vertical and horizontal actuators 318 are shown in FIG. 2, those ordinarily skilled in the art would understand that the actuators 318 could move the rollers in any direction that would allow the resonance frequency of the processing system to be adjusted, and the embodiments herein are not limited to the structures shown in FIG. 2, as FIG. 2 is merely an example of one way in which the embodiments herein could be configured. Other designs and configurations are equally applicable to the embodiments herein, depending upon the specific requirements of the device in question.

The apparatus 300 can also use one or more second component(s) 334 that are also operatively connected to the controller 330, sensors 322, network connection 324, user interface 326, etc. The second component 334 identifies the excitation frequencies of vibrations produced by the apparatus as the apparatus feeds the continuous media material 304 along the rollers (during the design phase or dynamically in real time during device operations) and supplies the excitation frequencies to the controller 330. The controller 330 then sets the target resonance frequency at a value that is different from the excitation frequencies. Again, the target resonance frequency that is set by the controller 330 can be at a value that is more than a predetermined frequency range outside the excitation frequencies so that the resonance frequency selected is well outside any potential excitation frequencies. In some embodiments the operation of the first component 332 and the second component 334 can be combined into a single component and these devices can be used during design phase and/or dynamically during device operation, as would be understood by those ordinarily skilled in the art.

If the supply roll 302 is changed to a different media material or if the sensors 332 detect more than a predetermined amount of change in an environmental condition, the first component 332 can supply second media characteristics to the controller 330. In turn, the controller 330 adjusts the position of at least one of the rollers (based on the second media characteristics) to cause the processing system with the second media material to exhibit a second resonance frequency when being processed through the rollers that is approximately the same as (or within a predetermined frequency range of) the target resonance frequency. In one example, the roller that is adjusted is the vertical location adjustment of the idler roll just prior to the pre-heat roll in a printing device. In another example, the roll prior to the driver in a printing device is a good candidate to adjust to control the resonance of the processing system.

FIG. 3 is a table illustrating the resonance frequencies (Hz) for different paper weights before and after the resonance tuner described herein is used. As shown, the first system resonance frequency is 15.661 Hz for 50 gsm (grams per square meter) paper, 19.137 Hz for 75 gsm paper and 23.194 Hz for 120 gsm when the adjustable roller is in the original position (starting, unmoved, home, or reference position). These first system resonance frequencies are shown graphed by velocity error (in minutes per second (min/sec)) in FIG. 4.

Figure 4:
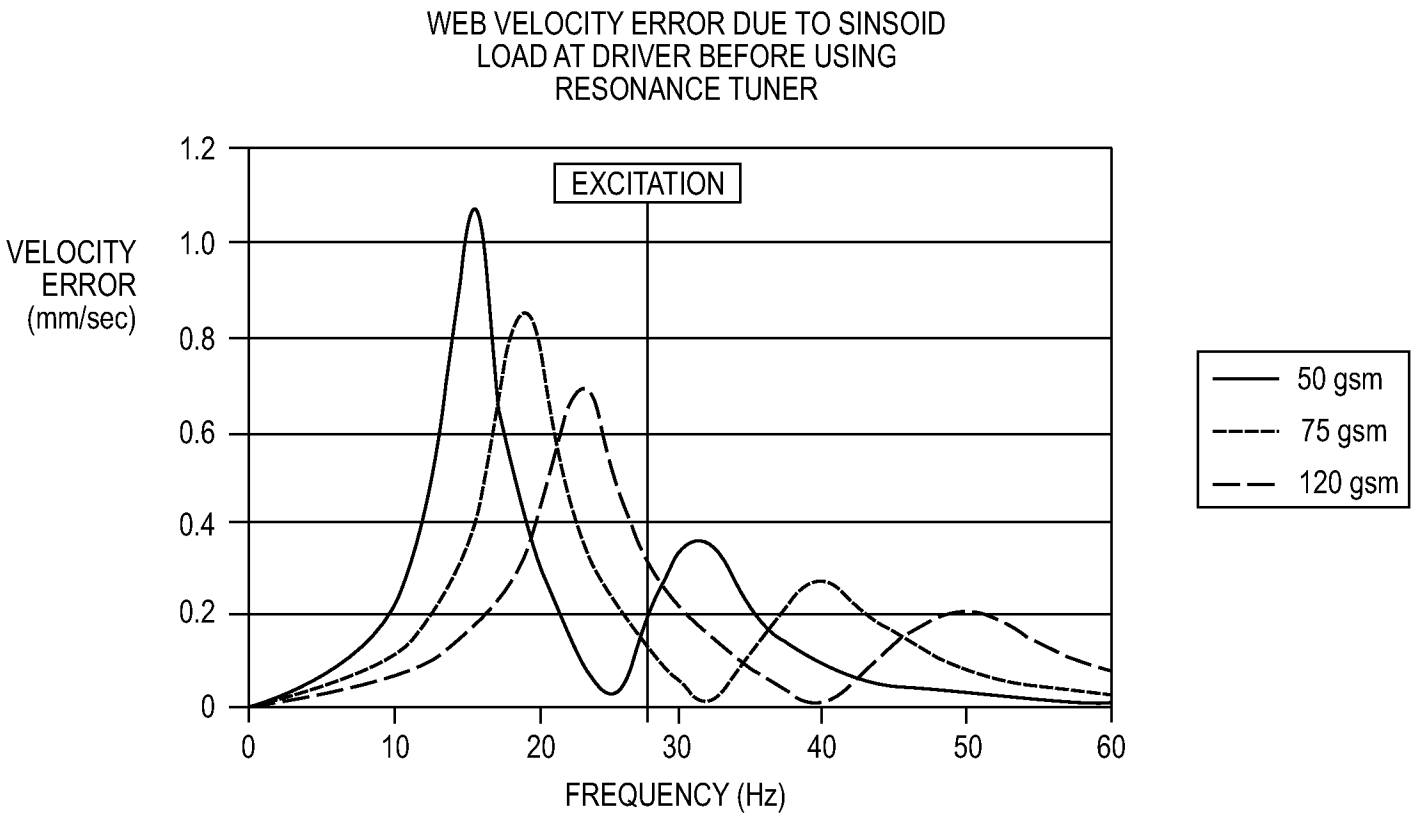
FIG. 4 is a chart illustrating resonance frequencies relative to an identified excitation frequency.
Figure 5:
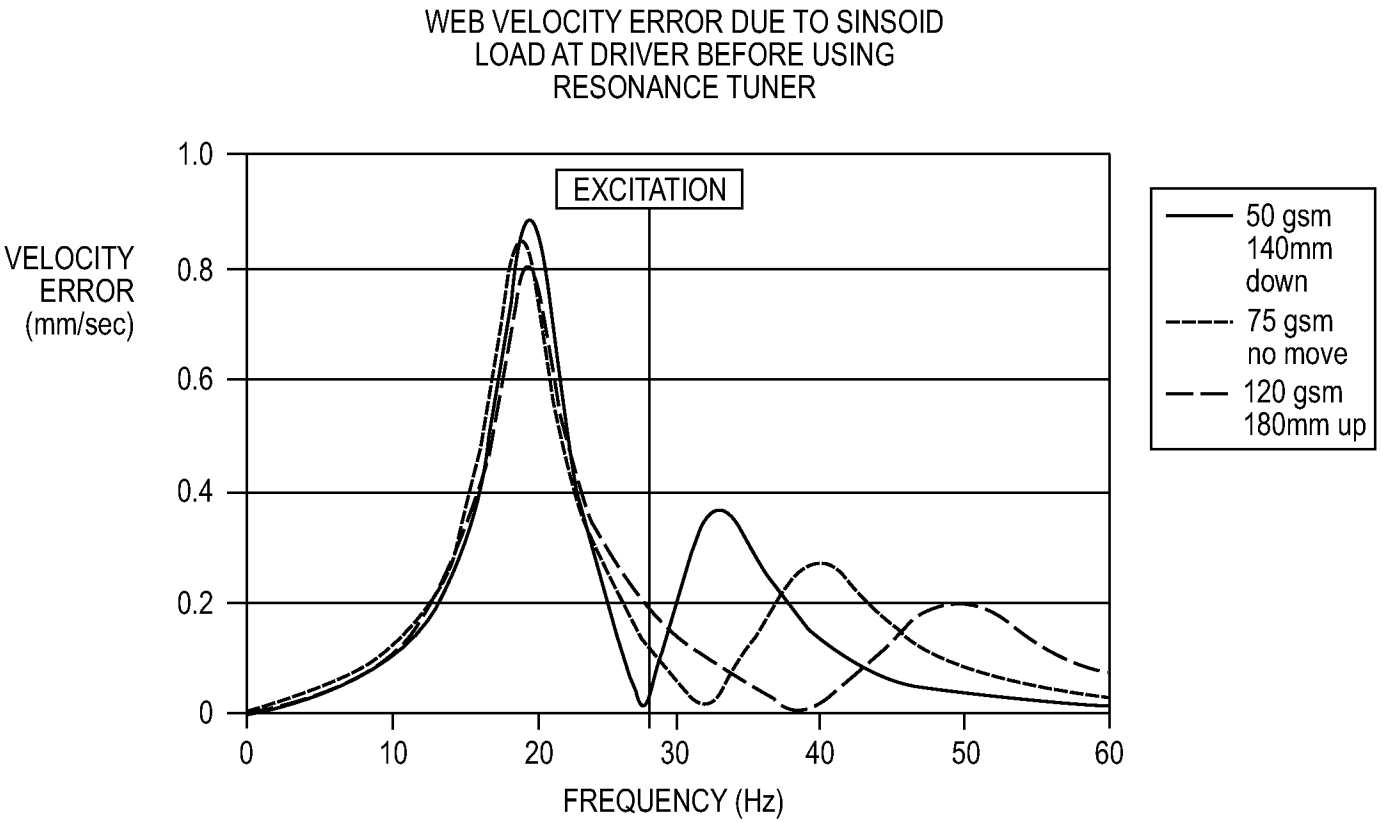
FIG. 5 is a chart illustrating resonance frequencies relative to an identified excitation frequency.

This shift in the resonance frequency for different paper weights shown in FIGS. 4 and 5 makes it very challenging to design a system to avoid the disturbance excitation from happening at resonance frequencies. The difficulty is it makes it necessary to avoid the range of frequencies shown in FIGS. 3 and 5 instead of a particular "single point" frequency.

By using the resonance tuner of embodiments herein, the location or one or more rollers is adjusted so that the critical system resonance frequency is still a "single point" value (for example, at around 19.137 Hz, the resonance frequency for 75 gsm paper) without moving the tuner from the reference position, as shown in FIG. 3, even though the transported media is changed. The last two columns of the table in FIG. 3 list the resulting resonance frequencies for both 50 gsm and 120 gsm paper when the tuner roller (e.g., 310, 316 in FIG. 2) is moved down 140 mm from the reference position for 50 gsm paper and up 180 mm from the reference position for 120 gsm paper. As shown in the table in FIG. 3, the range of the first resonance frequencies is reduced from between 15.661 and 23.194 Hz (when the tuner roller is in the original position) to a range of 19.137 to 19.823 Hz (when the tuner roller is moved). This is also illustrated in FIG. 5, where the tuned resonance frequencies are shown graphically against the frequency.

By allowing designers to work around fewer frequencies (such as the single frequency shown in FIG. 5) the design process is simplified and it is easier to achieve high registration quality.

Thus, the embodiments herein provide a system and method for improving the motion quality in continuous feed web printing systems by tuning the resonance frequency of the processing system. Continuous feed web handling systems should be designed such that no excitation occurs near the systems resonance frequencies; however, resonance frequencies will vary with media stiffness (paper weight, width, humidity, and temperature). Thus, the embodiments herein provide a system resonance tuner that modifies the web path length by adjusting the location of an idler roll or rolls. This modification results in a shift in system resonance. By using the tuner mechanism, a machine can be designed so that the main resonance occurs at the same frequency for any set of paper, environmental conditions, or processing speeds.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A method comprising:

providing one or more first media characteristics of a first continuous media material being supplied to rollers of an apparatus;

adjusting a position of at least one of said rollers relative to other rollers based on said first media characteristics to cause said first continuous media material and said rollers to exhibit a target resonance frequency when said first continuous media material is being processed through said rollers;

providing second media characteristics of a second continuous media material being supplied to said rollers of said apparatus; and adjusting said position of said at least one of said rollers based on said second media characteristics to cause said second continuous media material and said rollers to exhibit a second resonance frequency when said second continuous media material is being processed through said rollers.

2. The method according to claim 1, said second resonance frequency being within a predetermined frequency range of said target resonance frequency.

3. The method according to claim 2, said second continuous media material being different from said continuous media material and said second media characteristics being different from said media characteristics.

4. A method comprising:

providing one or more media characteristics of a continuous media material being supplied to rollers of an apparatus;

adjusting a position of at least one of said rollers relative to other rollers based on said media characteristics to cause said continuous media material and said rollers to exhibit a target resonance frequency when said continuous media material is being processed through said rollers:

identifying one or more excitation frequencies of vibrations produced by said apparatus as said apparatus feeds said continuous media material along said rollers; and setting said target resonance frequency at a value that is different from said excitation frequencies.

5. The method according to claim 4, said target resonance frequency being set at a value that is more than a predetermined frequency range outside said excitation frequencies.

6. A method comprising:

providing one or more first print media characteristics of a first continuous print media material being supplied to rollers of a printing apparatus;

adjusting a position of at least one of said rollers relative to other rollers based on said first print media characteristics to cause said first continuous print media material and said rollers to exhibit a target resonance frequency within a printing zone of said printing apparatus providing second print media characteristics of a second continuous print media material being supplied to said rollers of said printing apparatus; and adjusting said position of said at least one of said rollers based on said second print media characteristics to cause said second continuous print media material and said rollers to exhibit a second resonance frequency within said printing apparatus.

7. The method according to claim 6, said second resonance frequency being within a predetermined frequency range of said target resonance frequency.

8. The method according to claim 7, said second continuous print media material being different from said continuous print media material and said second print media characteristics being different from said print media characteristics.

9. A method comprising:

providing one or more print media characteristics of a continuous print media material being supplied to rollers of a printing apparatus;

adjusting a position of at least one of said rollers relative to other rollers based on said print media characteristics to cause said continuous print media material and said rollers to exhibit a target resonance frequency within a printing zone of said printing apparatus;

identifying one or more excitation frequencies of vibrations produced by said printing apparatus as said printing apparatus feeds said continuous print media material along said rollers; and setting said target resonance frequency at a value that is different from said excitation frequencies.

10. The method according to claim 9, said target resonance frequency being set at a value that is more than a predetermined frequency range outside said excitation frequencies.

* * * * *